US009108407B2

(12) United States Patent
Tamaki

(10) Patent No.: US 9,108,407 B2
(45) Date of Patent: Aug. 18, 2015

(54) LIQUID EJECTION APPARATUS

(71) Applicant: Shuichi Tamaki, Nagoya (JP)

(72) Inventor: Shuichi Tamaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/781,654

(22) Filed: Feb. 28, 2013

(65) Prior Publication Data

US 2013/0222470 A1 Aug. 29, 2013

(30) Foreign Application Priority Data

Feb. 29, 2012 (JP) ..... 2012-042983

(51) Int. Cl.
*B41J 2/165* (2006.01)

(52) U.S. Cl.
CPC .... *B41J 2/16505* (2013.01); *B41J 2002/16555* (2013.01)

(58) Field of Classification Search
CPC ..... B41J 2/16505
USPC ..... 347/21, 22, 29
See application file for complete search history.

(56) References Cited

U.S. PATENT DOCUMENTS 5,608,432 A * 3/1997 Yamaguchi ..... 347/33
6,158,838 A 12/2000 Capurso
6,491,369 B1 12/2002 Satoh et al.
7,748,821 B2 * 7/2010 Nakashima ..... 347/33
2010/0147891 A1 * 6/2010 Yoshihisa ..... 222/192
2011/0242204 A1 * 10/2011 Shinoda ..... 347/29
2012/0206537 A1 * 8/2012 Nukui et al. ..... 347/32
2013/0221127 A1 8/2013 Tamaki
2013/0222469 A1 8/2013 Tamaki

FOREIGN PATENT DOCUMENTS

JP 2008-207514 A 9/2008

OTHER PUBLICATIONS

United States Patent and Trademark Office, Notice of Allowance for U.S. Appl. No. 13/781,629 (related to above-captioned patent application), mailed Nov. 26, 2013.
United States Patent and Trademark Office, Notice of Allowance for U.S. Appl. No. 13/781,553, (related to above-captioned patent application), mailed Sep. 10, 2014.

* cited by examiner

*Primary Examiner* — Stephen Meier
*Assistant Examiner* — Renee I Wilson
(74) *Attorney, Agent, or Firm* — Baker Botts L.L.P.

(57) ABSTRACT

A controller is configured to regularly select one of (i) a moisturization operation with which air moisturized by a moisturization mechanism is moved to an ejection space by a ventilator while a capping mechanism is maintained to be in a capped state and (ii) a liquid discharge operation with which liquid is discharged through ejection openings by a discharger and conduct the selected operation while a recording command is not received. The controller is configured to conduct the liquid discharge operation after the moisturization operation while the recording command is not received.

7 Claims, 12 Drawing Sheets

FIG.12

<OPERATION PATTERN TABLE>

| | 1 | 2 | 3 | 4 |
|---|---|---|---|---|
| OPERATION PATTERN A | MOISTURIZATION OPERATION | MOISTURIZATION OPERATION | MOISTURIZATION OPERATION | LIQUID DISCHARGE OPERATION |
| OPERATION PATTERN B | MOISTURIZATION OPERATION | LIQUID DISCHARGE OPERATION | MOISTURIZATION OPERATION | LIQUID DISCHARGE OPERATION |
| OPERATION PATTERN C | MOISTURIZATION OPERATION | LIQUID DISCHARGE OPERATION | LIQUID DISCHARGE OPERATION | LIQUID DISCHARGE OPERATION |

※MOISTURIZATION OPERATION: MOISTURIZATION OPERATION → SWITCH TO POWER SAVING MODE

※LIQUID DISCHARGE OPERATION: LIQUID DISCHARGE OPERATION → WIPING → MOISTURIZATION OPERATION → SWITCH TO POWER SAVING MODE

LIQUID EJECTION APPARATUS

CROSS REFERENCE TO RELATED APPLICATION

The present application claims priority from Japanese Patent Application No. 2012-042983, which was filed on Feb. 29, 2012, the disclosure of which is incorporated herein by reference in its entirety.

BACKGROUND OF THE INVENTION

1. Field of the Invention

The present invention relates to a liquid ejection apparatus capable of ejecting liquid such as ink.

2. Description of Related Art

In connection with liquid ejection apparatuses, a technology concerning maintenance for restoring or maintaining the state of liquid in an ejection opening has been known. According to this technology, moist air is supplied to an ejection space opposing an ejection surface of a head for a predetermined time while the ejection space is separated from a space surrounding the ejection space by a capping mechanism.

SUMMARY OF THE INVENTION

While a recording command to record an image on a recording medium by ejecting the liquid through ejection openings is not received, a maintenance operation may be regularly conducted to restore or maintain the state of the liquid in the ejection openings. In such a case, if only the moisturization operation based on the technology above is conducted in each maintenance operation, the concentration of the liquid in the ejection openings becomes excessively low, with the result that the concentration of the liquid in the ejection openings may not be maintained to fall within a predetermined range.

An object of the present invention is to provide a liquid ejection apparatus capable of maintaining the concentration of liquid in ejection openings to fall within a predetermined range in a maintenance operation which is regularly conducted while the recording command is not received.

According to an aspect of the present invention, there is provided a liquid ejection apparatus comprising a head, a capping mechanism, a discharger, an inflow path, an outflow path, a moisturization mechanism, a ventilator, and a controller. The head comprises an ejection surface in which a plurality of ejection openings for ejecting liquid are formed. The capping mechanism is configured to selectively take a capped state in which an ejection space opposing the ejection surface is covered or an uncapped state in which the ejection space is not covered. The discharger is configured to discharge liquid in the head through the ejection openings. The inflow path is configured to be connected to the ejection space when the capping mechanism is in the capped state and to allow air flow towards the ejection space passing through the inflow path. The outflow path is configured to be connected to the ejection space when the capping mechanism is in the capped state and to allow air flow from the ejection space passing through the outflow path. The moisturization mechanism is configured to moisturize the air passing through the inflow path. The ventilator is configured to move the air in the inflow path to the ejection space. The controller is configured to: maintain the capping mechanism to be in the capped state while a recording command to record an image on a recording medium by ejecting the liquid through the ejection openings is not received; regularly select one of (i) a moisturization operation with which air moisturized by the moisturization mechanism is moved to the ejection space by the ventilator while the capping mechanism is maintained to be in the capped state and (ii) a liquid discharge operation with which the liquid is discharged through the ejection openings by the discharger and conduct the selected operation while the recording command is not received; and conduct the liquid discharge operation after the moisturization operation while the recording command is not received.

BRIEF DESCRIPTION OF THE DRAWINGS

Other and further objects, features and advantages of the invention will appear more fully from the following description taken in connection with the accompanying drawings in which:

FIG. 12 shows an operation pattern table stored in the ROM of the controller.

DESCRIPTION OF THE PREFERRED EMBODIMENTS

The following will describe a preferred embodiment of the present invention with reference to figures.

Figure 1:
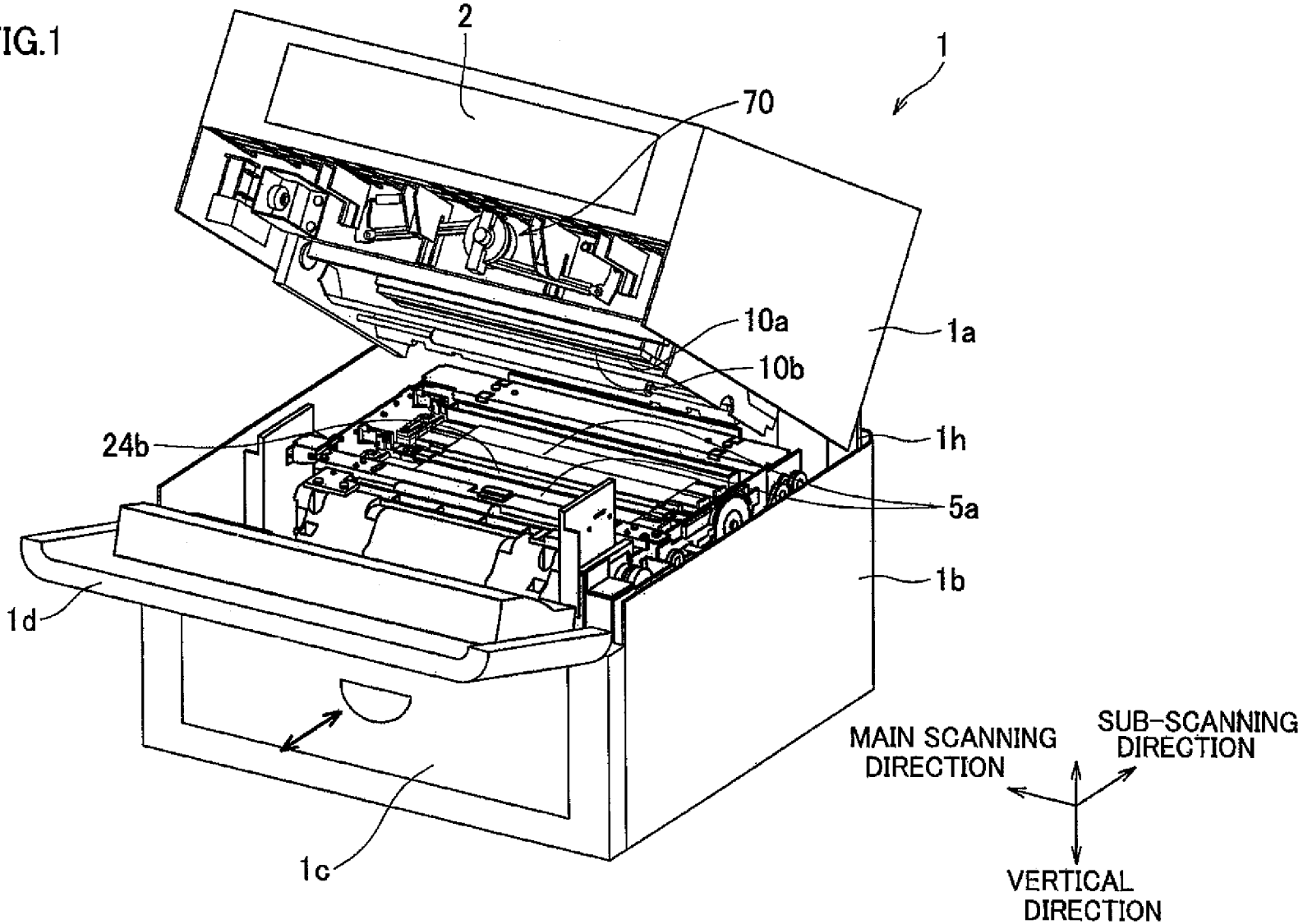
FIG. 1 is an oblique perspective of the appearance of an inkjet printer of First Embodiment of the present invention.

To begin with, referring to FIG. 1 and FIG. 2, the overall structure of an inkjet printer 1 of First Embodiment of the present invention will be described.

The printer 1 includes an upper housing 1*a* and a lower housing 1*b* which are both rectangular parallelepiped and are substantially identical in size. The upper housing 1*a* is an open-bottom box whereas the lower housing 1*b* is an open-top box. As the upper housing 1*a* is put on the lower housing 1*b* so that each closes the opening of the other, the space inside the printer 1 is defined (see FIG. 2).

On the top plate of the upper housing 1*a* is provided a sheet discharge section 31. In the space defined by the housings 1*a* and 1*b*, a conveying path on which sheets P are conveyed is formed from a sheet supply unit 1*c* toward a sheet discharge section 31, along the thick arrows shown in FIG. 2.

The upper housing 1*a* is arranged to be rotatable with respect to the lower housing 1*b* about a hinge 1*h* which is a lower side of the upper housing 1*a*. On account of the rotation, the upper housing 1*a* selectively takes a close position (FIG. 2) where the upper housing 1*a* is close to the lower housing 1*b* or a separated position (FIG. 1) where the upper housing 1*a* is separated from the lower housing 1*b* as compared to the close position. The upper housing 1*a* is regulated by a stopper or the like so as not to open more than a predetermined angle (e.g., 29 degrees) with respect to the horizontal plane. When the upper housing 1*a* is at the separated position, a part of the conveying path is exposed and a working space for the user is formed between the upper housing 1*a* and the lower housing 1*b*. This working space allows the user to manually clean heads 10*a* and 10*b*, remove a sheet P jammed at the conveying path, and so on.

On the front surface of the upper housing 1*a* (i.e., title face on the left side in FIG. 1) are provided a cartridge 2 and a locking mechanism 70. The cartridge 2 includes a preprocessing liquid container 2*a* containing preprocessing liquid, an ink container containing black ink 2*b*, a moisturizing liquid container 2*c* containing moisturizing liquid, and a housing 2*x* which houses these three containers 2*a* to 2*c* (see FIG. 9). The preprocessing liquid has a function of preventing ink from spreading on or penetrating a sheet, a function of improving the coloring and quick dry properties of the ink, or the like, by coagulating pigment in the ink. The preprocessing liquid may include polyvalent metal salt such as cationic polymer and magnesium salt. The moisturizing liquid may be water to which pure water, preservative or the like is added. The preprocessing liquid container 2*a*, the ink container 2*b*, and the moisturizing liquid container 2*c* are connected to a head 10*a*, a head 10*b*, and a tank 51 via tubes or the like, respectively. The liquid in each of the containers 2*a* to 2*c* is suitably supplied to each of the heads 10*a* and 10*b* and the tank 51 by the driving of pumps 2Pa, 2Pb, and 2Pc (see FIG. 11) under the control of the controller 1*p*. The locking mechanism 70 restricts the movement of the upper housing 1*a* when the upper housing 1*a* is at the close position. On the front surface of the lower housing 1*b* is provided a lid 1*d* which is openable and able to cover the front surface of the upper housing 1*a*. As the lid 1*d* is opened, the locking mechanism 70 is exposed. The details of the locking mechanism 70 will be given later.

Figure 2:
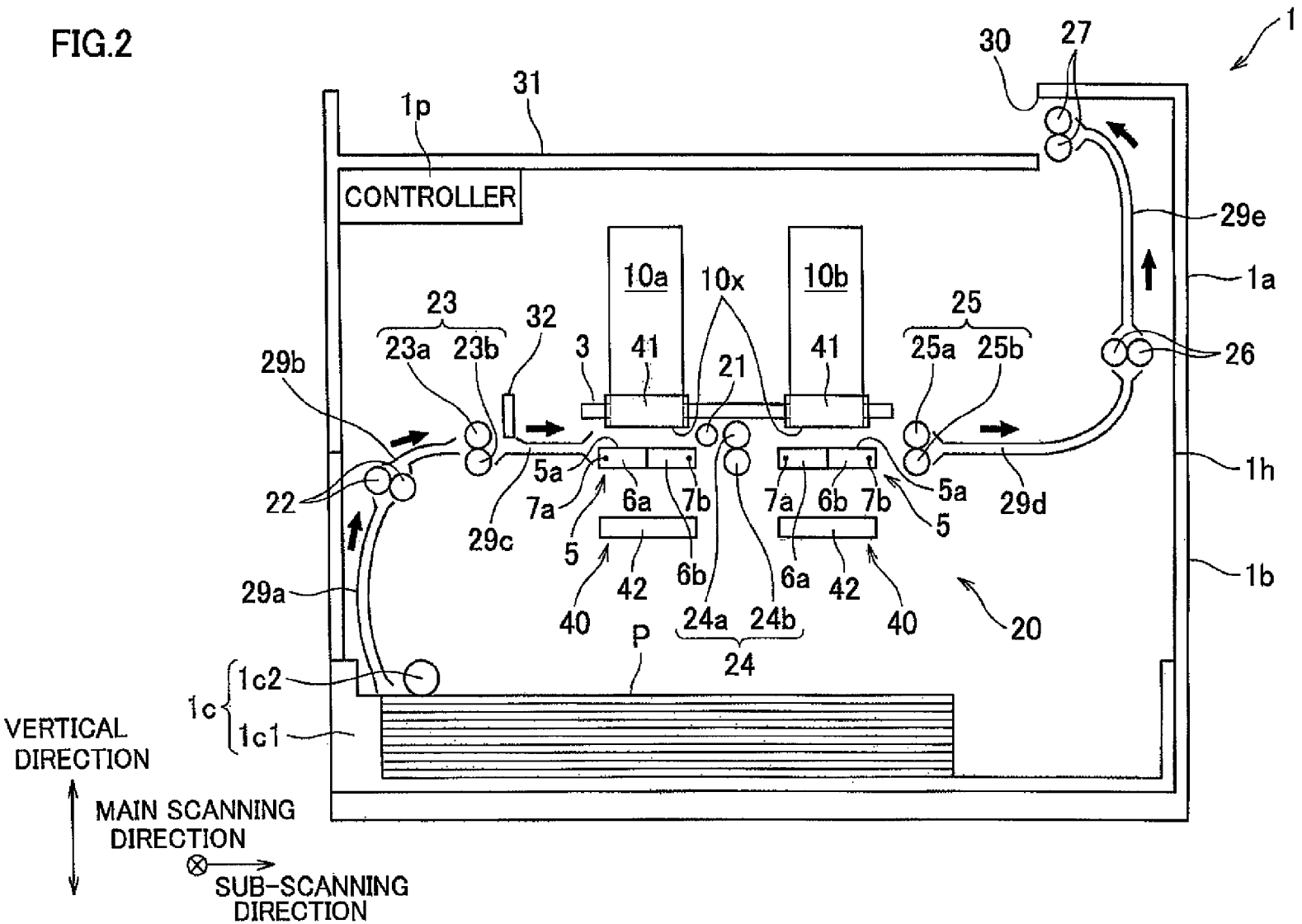
FIG. 2 is a schematic profile showing the internal structure of the printer.
Figure 8A:
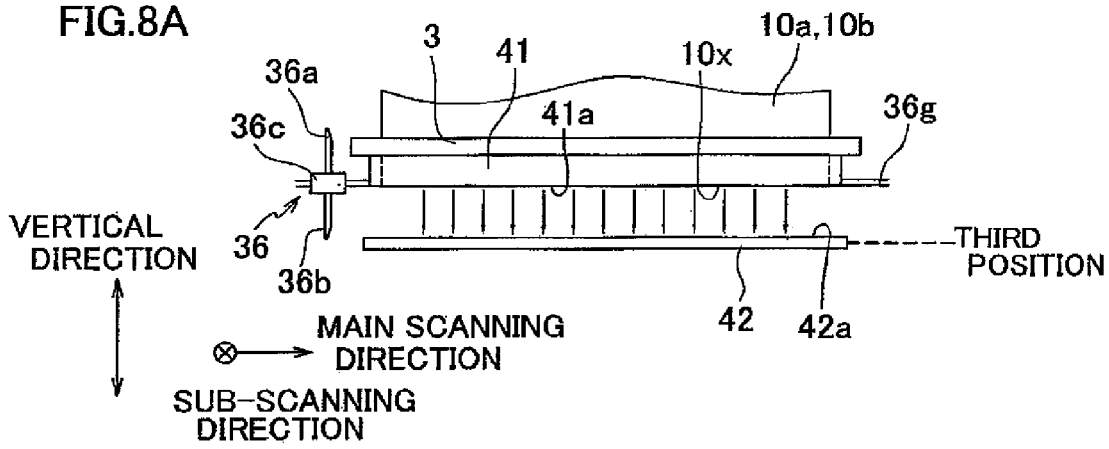
FIG. 8A illustrates purging.

The upper housing 1*a* supports members such as the heads 10*a* and 10*b*, a controller 1*p*, and a part of the conveying unit 20 (see FIG. 2). The lower housing 1*b* supports members such as opposing members 42, the remaining part of the conveying unit 20, a sheet supply unit 1*c*, wiper units 36 (see FIG. 8A to FIG. 8C) provided for the respective heads 10*a* and 10*b*, and a tank 51 (see FIG. 9) of the moisturizing unit 50.

The heads 10*a* and 10*b* are identical with each other in structure and are line-type heads each being substantially rectangular parallelepiped and long in the main scanning direction (i.e., in the direction orthogonal to FIG. 2). For recording (image formation), preprocessing liquid and black ink (which may be referred to generally as liquid) are ejected from the lower surface (ejection surface 10*x*) of each of the heads 10*a* and 10*b*. The heads 10*a* and 10*b* are disposed at predetermined intervals in the sub-scanning direction (which is orthogonal to the main scanning direction and the vertical direction), and are supported by the upper housing 1*a* via a holder 3. The holder 3 also supports an annular member 41 which is provided for each of the heads 10*a* and 10*b*. The annular member 41 encloses the ejection surface 10*x* in plan view.

The opposing members 42 are disposed vertically below the respective heads 10*a* and 10*b*. The opposing member 42 is a rectangular plate which is a size larger than the annular member 41 and made of a material which does not absorb or hardly absorbs moisture, such as glass and metal (e.g., SUS). The annular member 41 and the opposing member 42 constitute a capping mechanism 40. The details of the capping mechanism 40 will be given later.

The conveying unit 20 includes supporting mechanisms 5, roller pairs 22, 23, 24, 25, 26, and 27, guides 29*a*, 29*b*, 29*c*, 29*d*, and 29*e*, and an intermediate roller 21.

Among the members of the conveying unit 20, the intermediate roller 21, the upper roller 24*a* of the roller pair 24, the roller pairs 26 and 27, and the guides 29*d* and 29*e* are supported by the upper housing 1*a*. The supporting mechanisms 5, the roller pairs 22, 23, and 25, the lower roller 24*b* of the roller pair 24, and the guides 29*a*, 29*b*, and 29*c* are supported by the lower housing 1*b*.

The supporting mechanisms 5 are disposed vertically below the heads 10*a* and 10*b*, respectively. Each supporting mechanism 5 is constituted by two platens 6*a* and 6*b*. The platens 6*a* and 6*b* are arranged to be rotatable about the shafts 7*a* and 7*b*. Under the control of the controller 1*p*, the platens 6*a* and 6*b* are rotated by a platen rotation motor 5M (see FIG. 11), and selectively take a supporting surface forming position (FIG. 1) or an open position (FIG. 7B). At the supporting surface forming position, the leading ends of the platens 6*a* and 6*b* contact each other and these platens 6*a* and 6*b* form the supporting surface 5*a* which supports a sheet P while opposing the ejection surface 10*x*. The supporting surface 5*a* is basically flat in shape. At the open position the platens 6*a* and 6*b* hang down. The platens 6*a* and 6*b* are at the supporting surface forming position at the time of recording, and are at die open position at the time of capping, wiping, a liquid discharge operation (including flushing and purging), and a moisturization operation. The capping, the wiping, the liquid discharge operation, and the moisturization operation are conducted while the controller 1*p* is not receiving a recording command. The details of these operations will be given later.

The roller pairs 22 to 27 are disposed in this order from the upstream in the conveyance direction to form a conveying path connecting the sheet supply unit 1*c* with the sheet discharge section 31. The lower rollers 23*b*, 24*b*, and 25*b* of the roller pairs 23 to 25 and one rollers of the roller pairs 26 and 27 are connected to a conveyance motor 20M (see FIG. 11). These rollers are drive rollers which are rotated by the conveyance motor 20M under the control of the controller 1*p*. The upper rollers 23*a*, 24*a*, and 25*a* of the roller pair 23 to 25 and the other rollers of the roller pairs 26 and 27 are driven rollers.

The guides 29*a* to 29*e* are disposed in this order between the sheet supply unit 1*c* and the roller pair 22 and between the roller pairs from the upstream in the conveyance direction, so as to form the conveying path. Each of the guides 29*a* to 29*e* is constituted by a pair of plates which are distanced from each other.

The intermediate roller 21 is disposed between the head 10*a* and the roller pair 24 and vertically above the conveying path.

The sheet supply unit 1*c* includes a sheet feeding tray 1*c*1 and a pickup roller 1*c*2. The sheet feeding tray 1*c*1 is detachable to the lower housing 1*b* in the sub-scanning direction. The sheet feeding tray 1*c*1 is an open-top box capable of storing sheets P with different sizes. Under the control of the controller 1*p*, the pickup roller 1*c*2 is rotated by a pickup motor 1*c*M (see FIG. 11) to send out the vertically topmost sheet P in the sheet feeding tray 1*c*1.

The controller 1*p* includes, in addition to a CPU (Central Processing Unit) which is a processing unit, members such as a ROM (Read Only Memory), a RAM (Random Access Memory: including non-volatile RAM), an ASIC (Application Specific Integrated Circuit), an I/F (Interface), an I/O (Input/Output Port), and an internal timer for measuring time. The ROM stores a program executed by the CPU, various fixed data, or the like. The RAM temporarily stores data (such as image data) required for the execution of a program. The ASIC executes the rewriting, sorting or the like (e.g., signal processing and image processing) of image data. The I/F exchanges data with an external apparatus. The I/O deals with input/output of detection signals of various sensors. Alternatively, no ASIC may be provided and the rewriting, sorting or the like of image data may be performed by a program executed by the CPU or the like.

Based on a recording command supplied from an external apparatus (e.g., a PC connected to the printer 1), the controller 1*p* controls the preparation operation concerning recording, the supply/conveyance/discharge operation of a sheet P, a liquid ejection operation in sync with the conveyance of a sheet P, or the like, in order to form an image on the sheet P. A sheet P sent out from the sheet supply unit 1*c* passes through the spaces between the guides 29*a* to 29*e* and is conveyed in the conveyance direction, while being sandwiched between the roller pairs 22 to 21. Each time a sheet P passes through the position immediately below each of the heads 10*a* and 10*b* while being supported by the supporting surface 5*a*, each of the heads 10*a* and 10*b* is driven under the control of the controller 1*p* and liquid is ejected from an ejection opening 14*a* (see FIG. 6) of each ejection surface 10*x* to the surface of the sheet P, with the result that an image is formed on the sheet P. The operation to eject the liquid from the ejection opening 14*a* is performed based on a detection signal supplied from a sheet sensor 32 which detects the leading end of a sheet P. The sheet P is then conveyed upward and is discharged to the sheet discharge section 31 through an opening 30 which is formed at an upper part of the upper housing 1*a*.

Figure 3A:
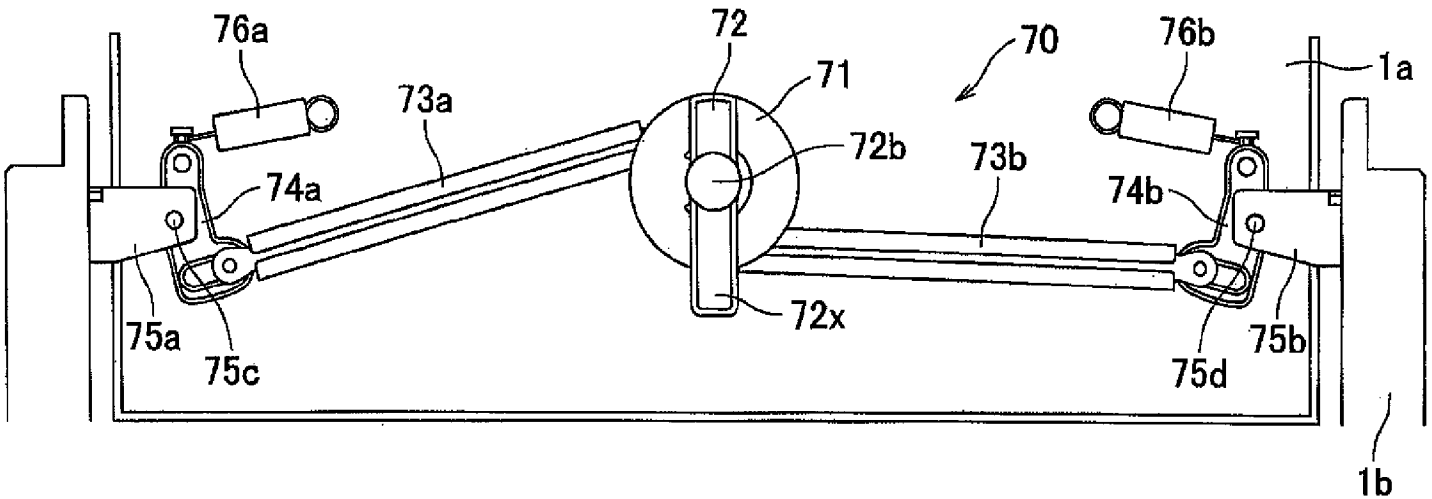
FIG. 3A is an elevation view of a locking mechanism, showing the state in which the movement of an upper housing is restricted by the locking mechanism.
Figure 3B:
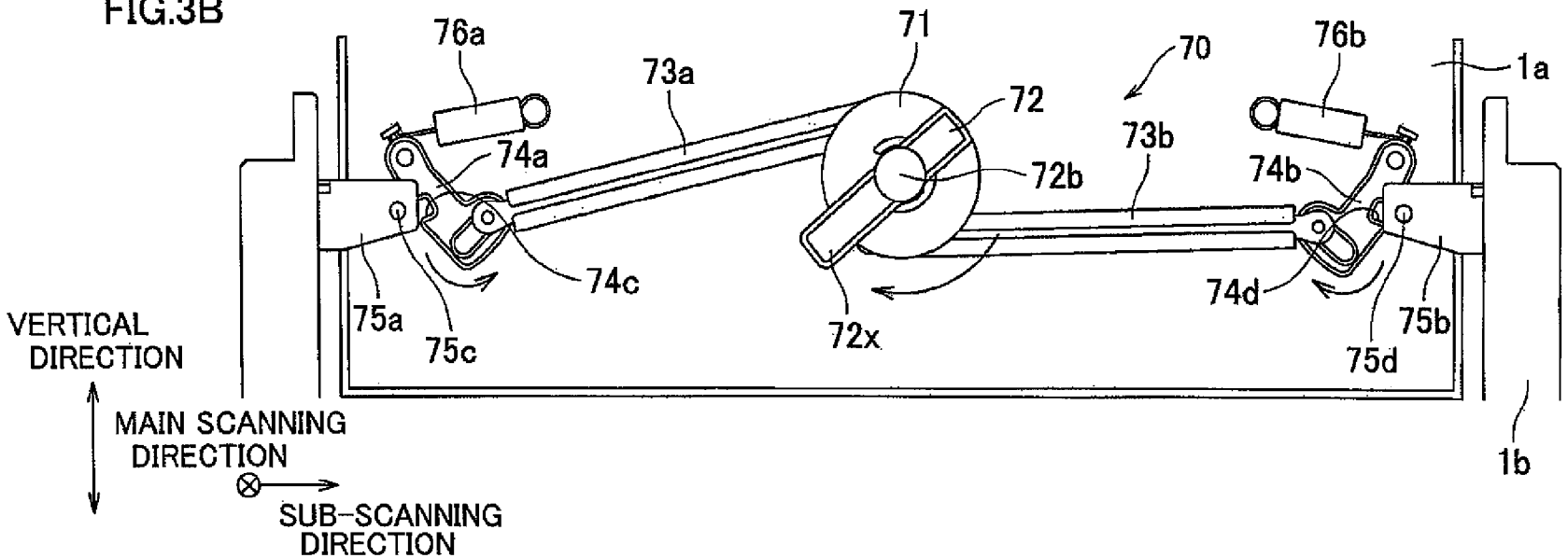
FIG. 3B is an elevation view of the locking mechanism, showing that the restriction of the movement of the upper housing by the locking mechanism has been released.

Now, referring to FIG. 3A and FIG. 3B, the details of the locking mechanism 70 will be given.

The locking mechanism 70 includes a cylindrical rotating member 71, two interlocking members 73*a* and 73*b*, two swing members 74*a* and 74*b*, two springs 76*a* and 76*b*, and two fixing members 75*a* and 75*b*. An end of each of the interlocking members 73*a* and 73*b* in the longitudinal direction is connected to the peripheral surface of the rotating member 71. The swing members 74*a* and 74*b* have concave portions 74*c* and 74*d* which are open in the directions away from the rotating member 71*a*, respectively. The fixing members 75*a* and 75*b* respectively have shaft members 75*c* and 75*d* which are capable of being inserted into the concave portions 74*c* and 74*d*, respectively. The swing shafts of the swing members 74*a* and 74*b* are fixed to the upper housing 1*a*. The springs 76*a* and 76*b* are fixed to the upper housing 1*a* at ends that are close to the rotating member 71*a*. The fixing members 75*a* and 75*b* are fixed to the lower housing 1*b*.

On the front surface of the rotating member 71 is fixed a stick-shaped knob 72. The knob 72 rotates together with the rotating member 71. The springs 76*a* and 76*b* bias the upper ends of the swing members 74*a* and 74*b* toward the rotating member 71. With the arrangement above, when no external force is applied, the members of the locking mechanism 70 are, as shown in FIG. 3A, in a static state while the knob 72 extends in the vertical direction. In this state, the concave portions 74*c* and 74*d* are engaged with the shaft members 75*c* and 75*d*, respectively. Because of this engagement, the movement of the upper housing 1*a* is restricted so that the upper housing 1*a* at the close position do not rotate toward the separated position. As the user rotates the knob 72 clockwise against the biasing forces of the springs 76*a* and 76*b*, as shown in FIG. 3B, the concave portions 74*c* and 74*d* are disengaged from the shaft members 75*c* and 75*d*. With this, the restriction of the movement of the upper housing 1*a* is released. As the upper housing 1*a* is returned from the separated position to the close position, the concave portions 74*c* and 74*d* are engaged with the shaft members 75*c* and 75*d* again. With this, the movement of the upper housing 1*a* is restricted by the locking mechanism 70 again.

Figure 4:
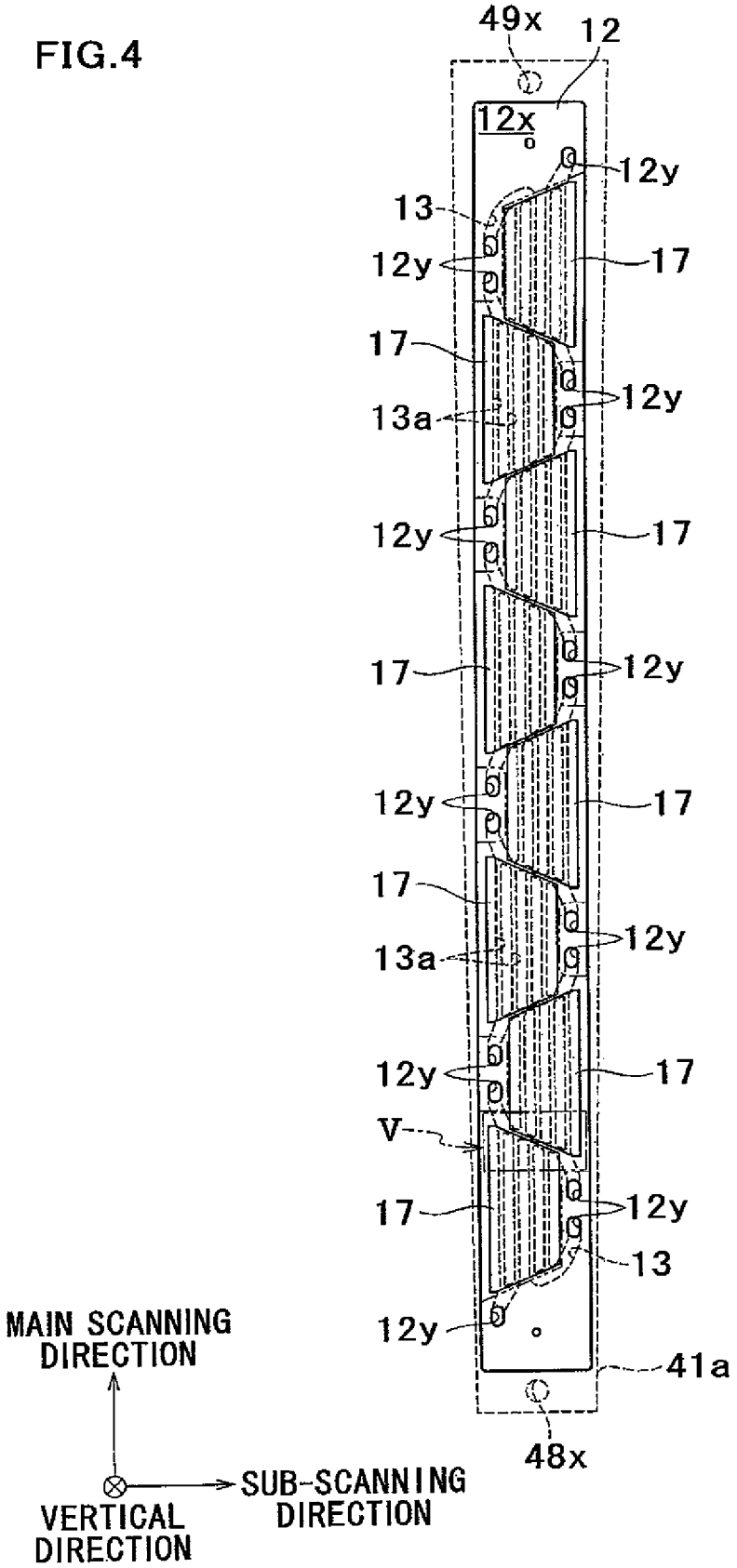
FIG. 4 is a plan view of a passage unit and an actuator unit of a head.
Figure 5:
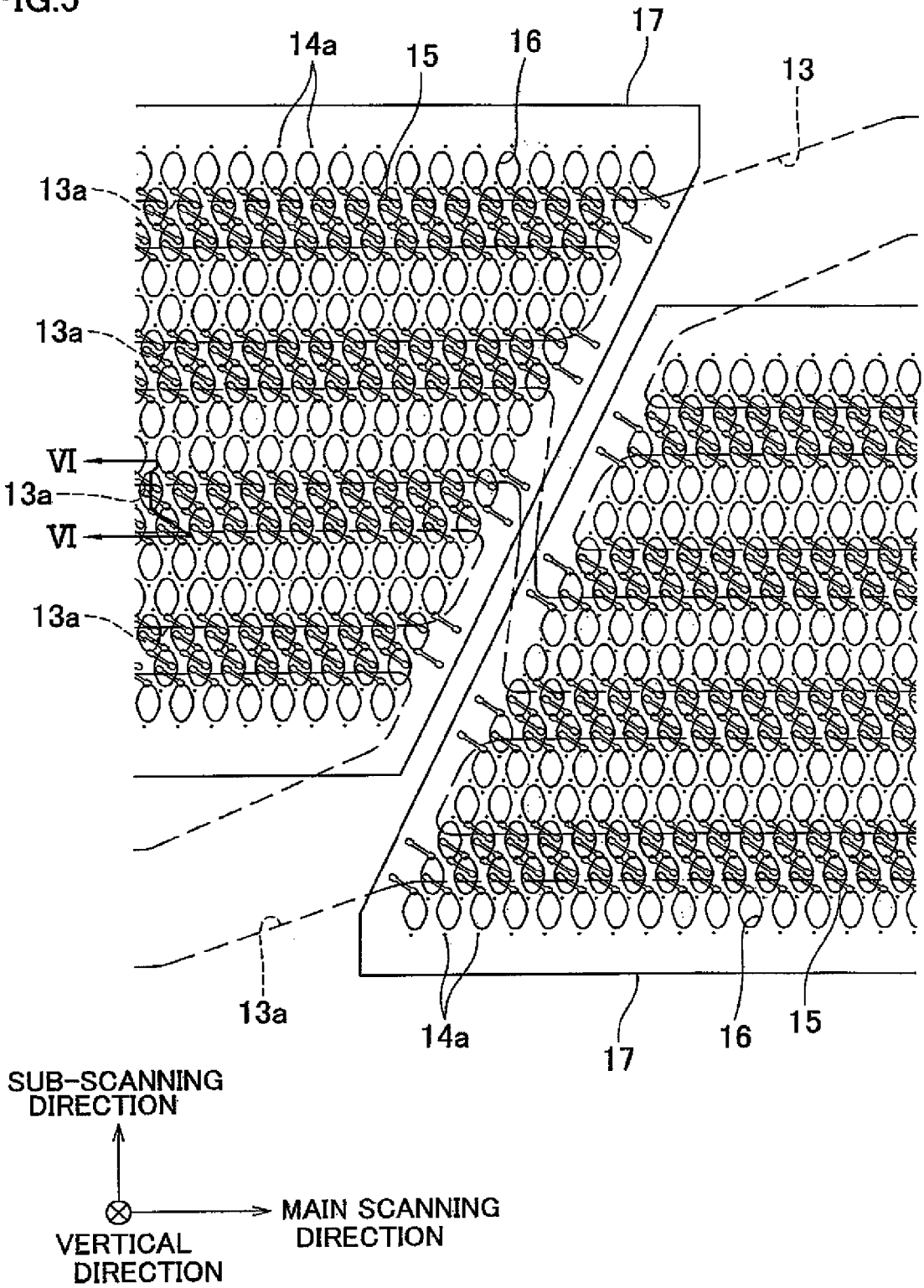
FIG. 5 is an enlarged view of the region V enclosed by the dashed line in FIG. 4.
Figure 6:
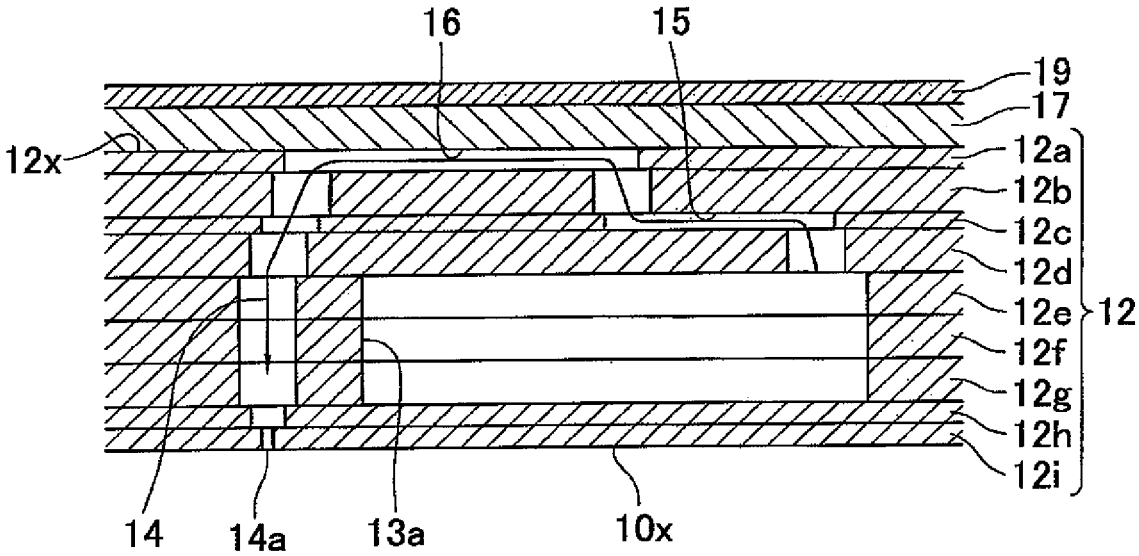
FIG. 6 is a partial cross section taken along the VI-VI line in FIG. 5.

Now, referring to FIG. 4 to FIG. 6, the arrangement of the heads 10*a* and 10*b* will be detailed.

Each of the heads 10*a* and 10*b* includes members such as a reservoir unit and a passage unit 12 which are vertically piled up, eight actuator units 17 fixed to the upper surface 12*x* of the passage unit 12, and an FPC (flat flexible circuit board) 19 connected to each actuator unit 17. In the reservoir unit, a passage including a reservoir Which temporarily stores liquid supplied from the corresponding container 2*a*, 2*b* of the cartridge 2 is formed. In the passage unit 12, a passage from the opening 12*y* of the upper surface 12*x* to each ejection opening 14*a* of the lower surface (ejection surface 10*x*) is formed. The actuator unit 17 includes a piezoelectric actuator for each ejection opening 14*a*.

The lower surface of the reservoir unit has concaves and protrusions. Each of the protrusions is adhered to a region (enclosed by a two dot chain line and including an opening 12*y* shown in FIG. 4) which is on the upper surface 12*x* of the passage unit 12 and where no actuator unit 17 is disposed. The leading end surface of the protrusion has an opening which is connected to the reservoir and opposes each opening 12*y* of the passage unit 12. With this, the reservoir is connected to individual passages 14 via each opening above. The concave portion opposes the upper surface 12*x* of the passage unit 12, the surface of the actuator unit 17, and the surface of the FPC 19, with a slight gap being formed therebetween.

The passage unit 12 is a laminated body formed by laminating nine rectangular metal plates 12*a*, 12*b*, 12*c*, 12*d*, 12*e*, 12*f*, 12*g*, 12*h*, and 12*i* which are substantially identical in size and by adhering the plates with one another (see FIG. 6). The passage is the passage unit 12 includes a manifold passage 13 having an opening 12*y* at one end, a sub-manifold passage 13*a* branching from the manifold passage 13, and an individual passage 14 which connects the outlet of the sub-manifold passage 13*a* with the ejection opening 14*a* via the pressure chamber 16. The individual passage 14 is formed for each ejection opening 14*a* and includes an aperture 15 which is an aperture for adjusting the flow resistance. At the region on the upper surface 12*x* to which region each actuator unit 17 is adhered, substantially diamond-shaped openings are formed in a matrix manner to expose the pressure chambers 16. At a region on the lower surface (ejection surface 10*x*) which region opposes the region to which each actuator unit 17 is adhered, ejection openings 14*a* are formed in a matrix manner and in the same arrangement as the pressure chambers 16.

In connection with the above, in FIG. 5, the pressure chambers 16 and the apertures 15 are depicted by full lines even if they are underneath the actuator unit 17.

The actuator units 17 are each trapezoidal in plan view and are staggered on the upper surface 12*x* of the passage unit 12 to form two lines. Each actuator unit 17 covers a plurality of openings of the pressure chambers 16, which are formed in the region where the actuator unit 17 is adhered. Although not illustrated, the actuator unit 17 is constituted by a piezoelectric layer, a diaphragm, a common electrode, and individual electrodes. Among these members, the piezoelectric layer, the diaphragm, and the common electrode are all trapezoidal and sized to define the outer shape of the actuator unit 17. The individual electrodes are provided for the respective pressure chambers 16 and are disposed on the upper surface of the piezoelectric layer to oppose the respective pressure chambers 16. The diaphragm is disposed between the common electrode and the passage unit 12. A part of the actuator unit 17 which part corresponds to each individual electrode functions as a piezoelectric actuator. Each actuator is independently deformable in response to the application of a voltage via the FPC 19. The actuator changes the capacity of the corresponding pressure chamber 16 to provide an energy to the liquid in the pressure chamber 16. With this, the liquid is ejected through the ejection opening 14*a*.

The FPC 19 is provided with a driver IC and wires which correspond to the respective electrodes of the actuator unit 17. The FPC 19 is fixed to the actuator unit 17 at one end and fixed to the control substrate of the head 10*a* or 10*b* at the other end. The control substrate adjusts a signal supplied from the controller 1*p* and inputs the adjusted signal to the driver IC via the wire of the FPC 19. The driver IC converts the signal input from the control substrate to a drive signal and sends the drive signal to each electrode of the actuator unit 17 via the wire of the FPC 19.

Now, referring to FIG. 7A to FIG. 9, the arrangement of the capping mechanism 40, the arrangement of the moisturizing unit 50, the arrangement of the wiper unit 36, the operations such as the capping, the wiping, the liquid discharge operation, and the moisturization operation, or the like will be described below.

The annular member 41 is connected with a plurality of gears 43 (see FIG. 9), and moves up or down as the gears 43 are rotated by an annular member elevating motor 41M (see FIG. 11) under the control of the controller 1*p*.

The opposing member 42 is connected to the opposing member elevating motor 42M (see FIG. 11) and moves up or down by the opposing member elevating motor 42M under the control of the controller 1*p*. The opposing member 42 takes one of a first position a second position, a third position, and a fourth position (see FIG. 7A and FIG. 7B). The first position is the highest, the second position is the second highest, the third position is the third highest, and the fourth position is the lowest.

The opposing member 42 is at the first position when the capping or flushing is conducted. The opposing member 42 is at the second position when the opposing surface 42*a* (which is the surface of the opposing member 42 and opposes the ejection surface 10*x* when the platens 6*a* and 6*b* are at the open position) is wiped. The opposing member 42 is at the third position when the wiping or purging of the ejection surface 10*x* is conducted. The opposing member 42 is at the fourth position when the recording is conducted or the apparatus is on standby. The separation distance between the opposing surface 42*a* and the ejection surface 10*x* when the opposing member 42 is at the first position is identical with the separation distance between the supporting surface 5*a* and the ejection surface 10*x* at the time of the recording.

Figure 7A:
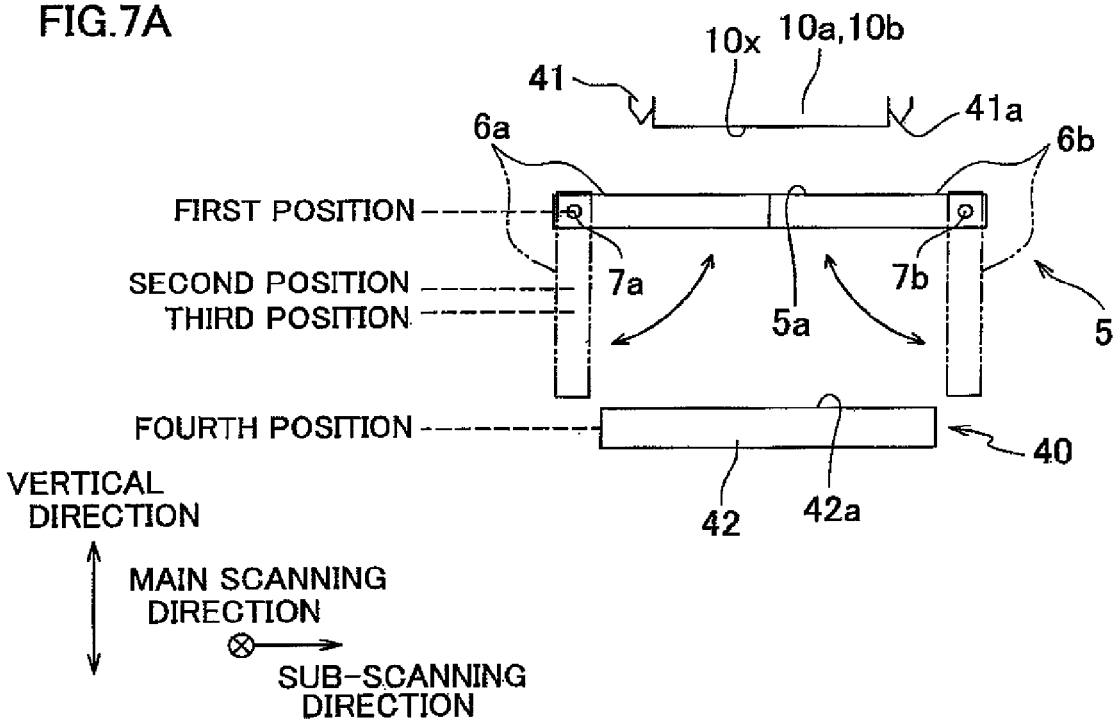
FIG. 7A and FIG. 7B illustrate the operations of a capping mechanism and a supporting mechanism.
Figure 7B:
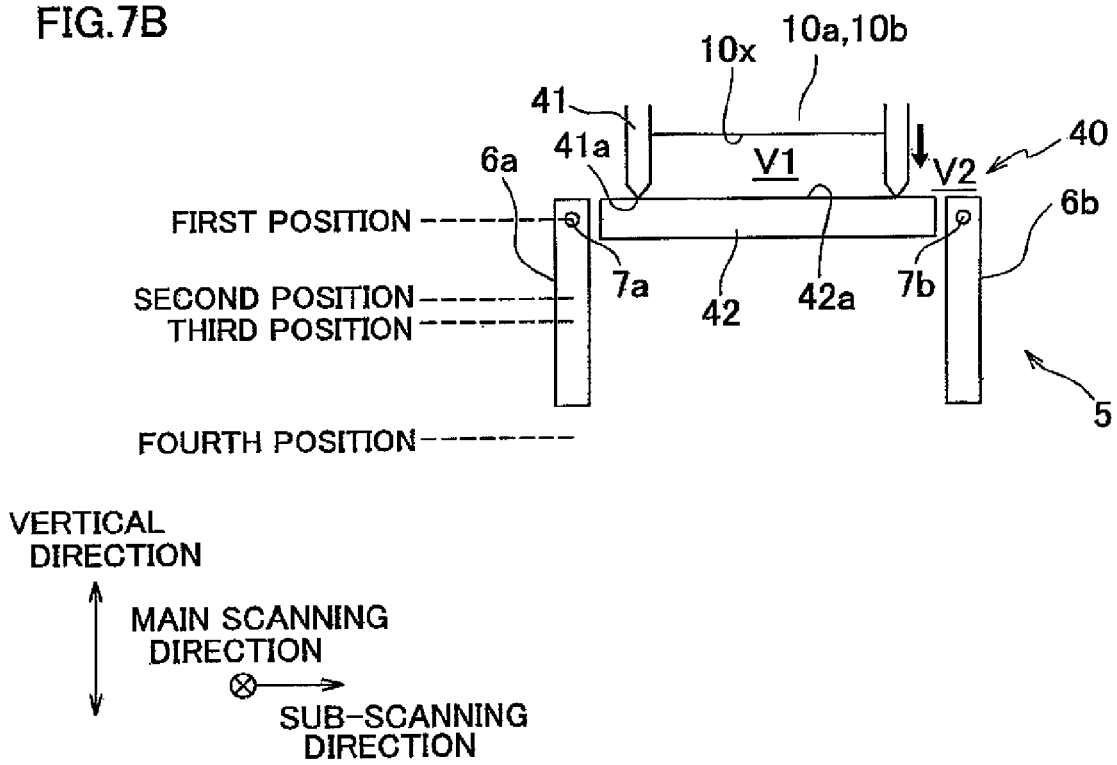

The capping mechanism 40 selectively takes a capped state (see FIG. 7B and FIG. 9) or an uncapped state (see (FIG. 2 and FIG. 7A). In the capped state, the ejection space V1 opposing the ejection surface 10*x* of the corresponding head 10*a* or 10*b* is covered, and separated from the space V2 which surrounds the ejection space V1. At the uncapped state, the ejection space V1 opposing the ejection surface 10*x* of the corresponding head 10*a* or 10*b* is not covered, and open to the space V2 surrounding the ejection space V1. The capping is an operation to maintain the capping mechanism 40 to be in the capped state. To change the state of the capping mechanism 40 to the capped state, as shown in FIG. 7B, the controller 1*p* moves down the annular member 41 while the supporting mechanism 5 is set at the open position and the opposing member 42 is set at the first position. As a result, the leading end 41*a* of the annular member 41 contacts the opposing surface 42*a* and hence the closed ejection space V1 is formed between the opposing surface 42*a* and the ejection surface 10*x*. By the capping, the drying of the ejection space V1 is prevented and the increase in the viscosity of the liquid in the ejection opening 14*a* is restrained.

The flushing is an operation to discharge liquid through the ejection opening 14*a* by driving the actuator unit 17 based on flushing data which is different from recording data (image data). The purging is an operation to discharge liquid through the ejection opening 14*a* by supplying the liquid to the head 10*a* or 10*b* by using a pump 2Pa, 2Pb (see FIG. 11) and then applying a pressure to the liquid in the head 10*a* or 10*b*. The flushing and the purging are carried out when, for example, no liquid is ejected from the ejection opening 14*a* at least for a predetermined time (this predetermined time may be different between the flushing and the purging) or carried out as a later-described maintenance operation. By the flushing or the purging, liquid with increased viscosity in the ejection opening 14*a* and liquid contaminated with foreign matters (dust, bubbles or the like) are discharged and the ejection properties are restored.

When the flushing is conducted, the controller 1*p* sets the supporting mechanism 5 at the open position and sets the opposing member 42 at the first position, and drives the actuator unit 17 of the head 10*a* or 10*b* while the leading end 41*a* of the annular member 41 is positioned either at the same height as the ejection surface 10*x* or vertically above the ejection surface 10*x*. When the purging is conducted, the controller 1*p* sets the supporting mechanism 5 at the open position and sets the opposing member 42 at the third position, and drives the pump 2Pa, 2Pb while the leading end 41*a* of the annular member 41 is either at the same height as the ejection surface 10*x* or vertically above the ejection surface 10*x*. The liquid discharged on account of the flushing or the purging is received by the opposing surface 42*a*.

The wiping is an operation to remove a foreign matter on a target by causing a wiper to contact the target and moving the wiper relative to the target. The wiping is conducted by using a wiper unit 36 (see FIG. 8A to FIG. 8C). There are two types of the wiping, namely, the wiping of the ejection surface 10*x* and the wiping of the opposing surface 42*a*. For example, the wiping of the ejection surface 10*x* is conducted after the completion of the purging, whereas the wiping of the opposing surface 42*a* is conducted after the wiping of the ejection surface 10*x* after the completion of the purging, and also after the completion of the flushing.

The wiper unit 36 includes two wipers 36*a* and 36*b* and a base portion 36*c* supporting the wipers 36*a* and 36*b*. The wipers 36*a* and 36*b* are both plate-shaped members made of an elastic member (such as rubber), and protrude upward and downward from the upper surface and the lower surface of the base portion 36*c*, respectively. In the sub-scanning direction, the wiper 36*a* is slightly longer than the length of the ejection surface 10*x* and the wiper 36*b* is slightly longer than the length of the opposing surface 42*a*. The base portion 36*c* is connected to a wiper drive motor 36M (see FIG. 10), and is able to be reciprocated in the main scanning direction along the guide hole 36*g* by the wiper drive motor 36M under the control of the controller 1*p*. The home position of the base portion 36*c* is to the left of the heads 10*a* and 10*b* in FIG. 8A (i.e., the position where the base portion 36*c* is provided in FIG. 8A).

Figure 8B:
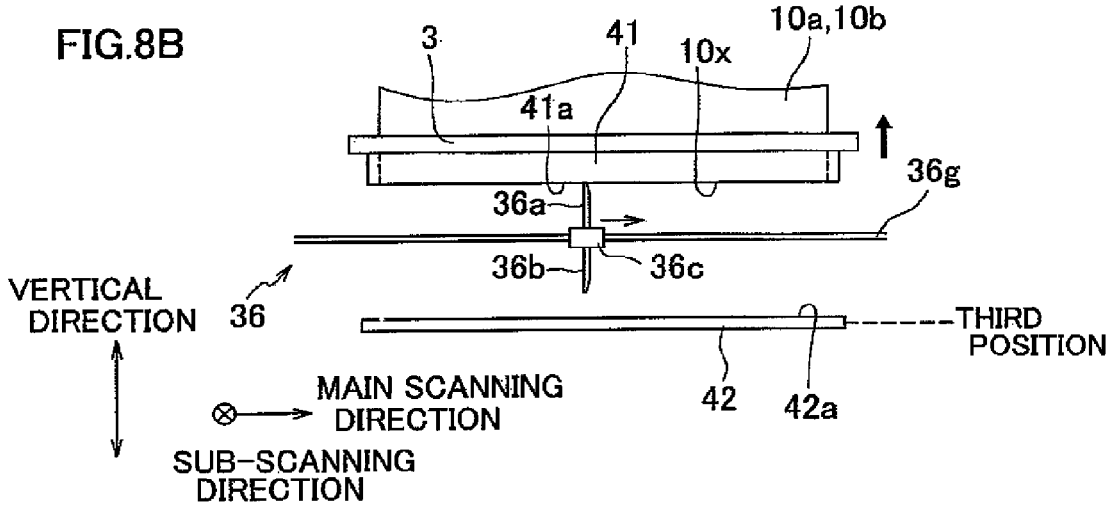
FIG. 8B and FIG. 8C illustrate wiping.
Figure 10:
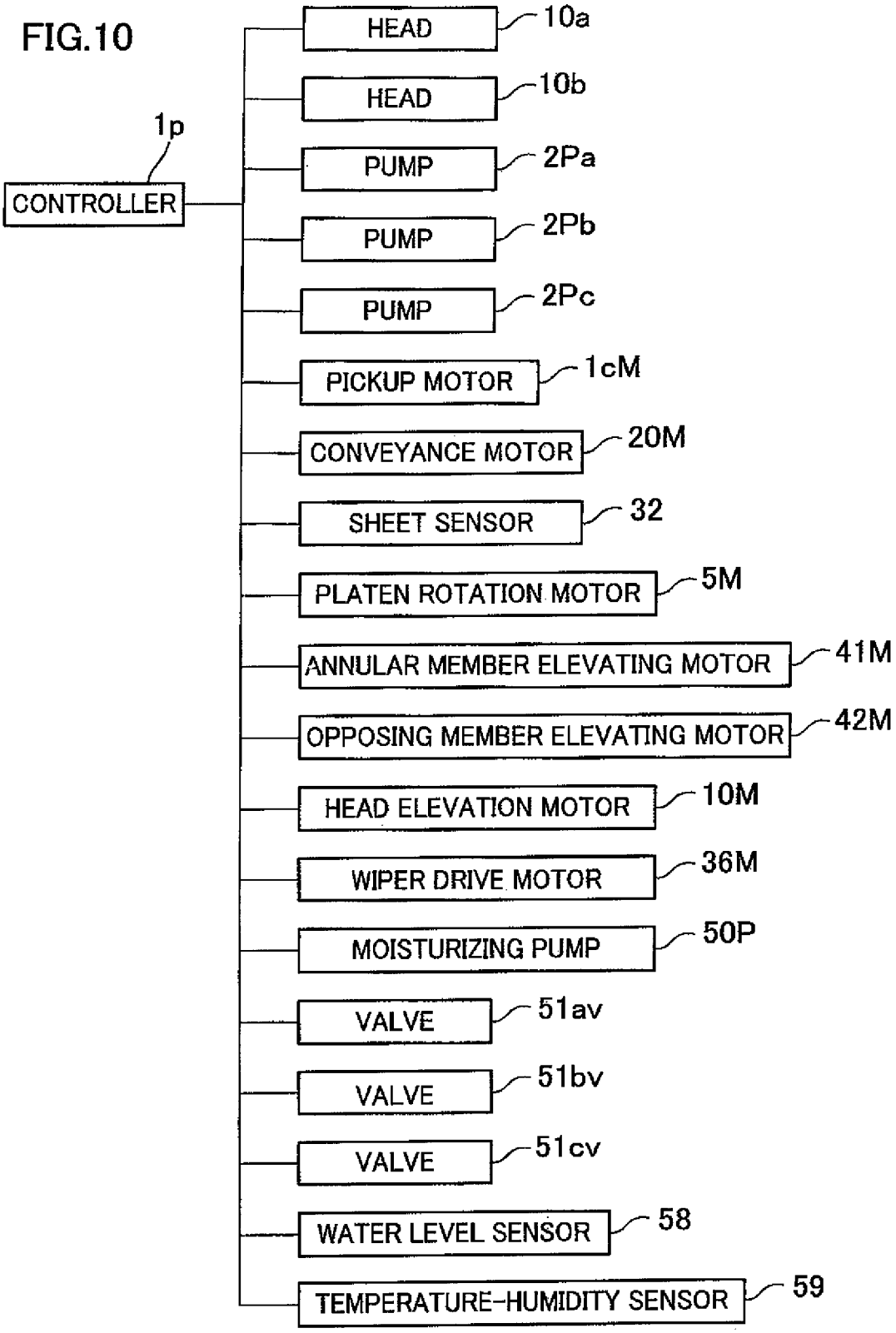
FIG. 10 is an oblique perspective of a tank in a moisturizing unit.

When the wiping of the ejection, surface 10*x* is conducted, as shown in FIG. 8B, the controller 1*p* moves up the heads 10*a* and 10*b* together with the holder 3 by driving a head elevation motor 10M (see FIG. 10). The controller 1*p* then positions the supporting mechanism 5 at the open position and positions the opposing member 42 at the third position, and drives the wiper drive motor 36M while the leading end 41*a* of the annular member 41 is at the same height as the ejection surface 10*x* or vertically above the ejection surface 10*x*. With this, the base portion 36*c* moves rightward in FIG. 8B from the home position and a part of the wiper 36*a* around its leading end moves relative to the ejection surface 10*x* while contacting the ejection surface 10*x*. As a result, foreign matters on the ejection surface 10*x* are removed. To conduct the wiping of the opposing surface 42*a* subsequent to the wiping of the ejection surface 10*x*, the controller 1*p* causes the base portion 36*c* to be on standby at a position to the right of the heads 10*a* and 10*b* in FIG. 8B.

Figure 8C:
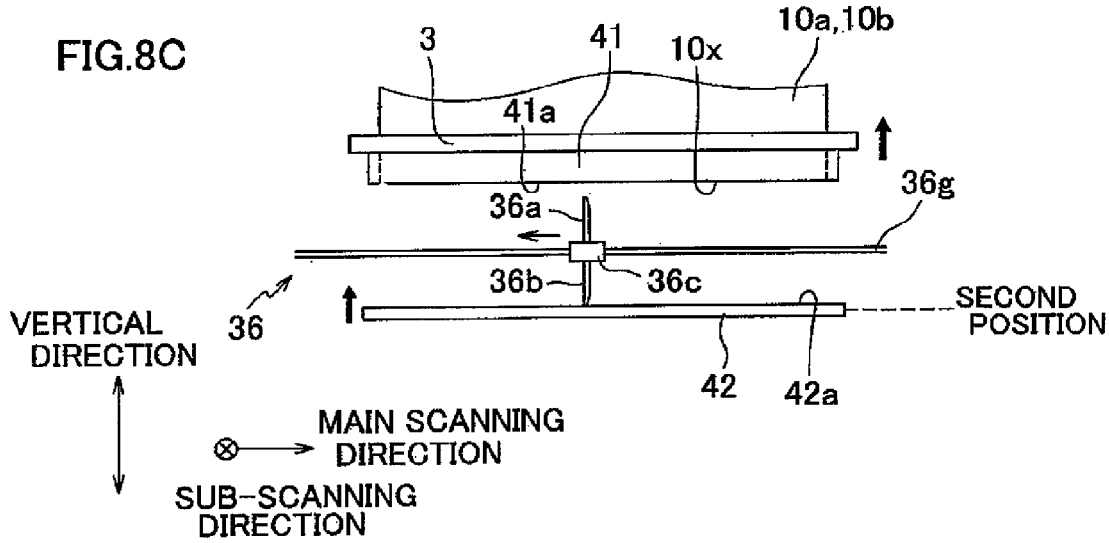

To conduct the wiping of the opposing surface 42*a*, as shown in FIG. 8C, the controller 1*p* moves up the heads 10*a* and 10*b* together with the holder 3 by driving a head elevation motor 10M (see FIG. 10), so as to position the heads 10*a* and 10*b* to be vertically above the position in the wiping of the ejection surface 10*x* shown in FIG. 8B. The controller 1*p* then positions the supporting mechanism 5 at the open position and positions the opposing member 42 at the second position, and drives the wiper drive motor 36M while the leading end 41*a* of the annular member 41 is at the same height as the ejection surface 10*x* or is vertically above the ejection surface 10*x*. With this, a part of the wiper 36*b* around its leading end moves relative to the opposing surface 42*a* while contacting the opposing surface 42*a*. As a result, foreign matters on the opposing surface 42*a* are removed.

To conduct the wiping of the opposing surface 42*a* subsequent to the wiping of the ejection surface 10*x*, the controller 1*p* moves the base portion 36*c* leftward as shown in FIG. 8C and stops it at the home position. With this movement, the opposing surface 42*a* is wiped. On the other hand, in cases other than the above, the controller 1*p* moves the base portion 36*c* rightward from the home position in FIG. 8C and stops it at a position to the right of the heads 10*a* and 10*b*. With this movement, the opposing surface 42*a* is wiped. After moving the opposing member 42 to the fourth position, the controller 1*p* moves the base portion 36*c* leftward in FIG. 8C and stops it at the home position.

The moisturization operation is an operation to moisturize the ejection space V1 by driving a moisturizing pump 50P (see FIG. 9) of the moisturizing unit 50 while keeping the capping mechanism 40 to take the capped state. By the moisturization operation, moisturized air is supplied into the ejection space V1 and hence the increase in the viscosity of the liquid in the ejection opening 14*a* is restrained.

The moisturizing unit 50 includes a tank 51 which stores moisturizing liquid, two tubes 52*a*, two tubes 52*c*, and a moisturizing pump 50P. Each of the two tubes 52*a* connects the tank 51 with a joint 48 of the head 10*a* or 10*b*, and has an outflow path 52*af* therein. The outflow path 52*af* is connected to a space 51V in the tank 51, and is connected to the ejection space V1 when the capping mechanism 40 is in the capped state. Air flowing out from the ejection space V1 passes through the outflow path 52*af*. Each of the two tubes 52*c* connects the tank 51 with a joint 49 of the head 10*a* or 10*b* and has an inflow path 52*cf* therein. The inflow path 52*cf* is connected to the space 51V, and is connected to the ejection space V1 when the capping mechanism 40 is in the capped state. Air flowing towards the ejection space V1 passes through the inflow path 52*cf*. The two joints 48 and 49 are provided for each of the heads 10*a* and 10*b*, and are disposed at one end and the other end of each of the heads 10*a* and 10*b* in the main scanning direction. The joints 48 and 49 are attached to the annular member 41. Each of the joints 48 and 49 is substantially cylindrical and connects the ejection space V1 with the space surrounding the ejection space V1 by the internal space of the same. The moisturizing pump 50P is disposed on a non-edge part of each tube 52*c*.

On the upper surface of the tank 51 is provided protruding portions 51*a*, 51*b*, and 51*c* which are cylindrical in shape and protrude upward. At the leading ends of the two protruding portions 51*a*, the tubes 52*a* are attached, respectively. At the leading ends of the two protruding portions 51*c*, the tubes 52*c* are attached, respectively. The proximal ends of the protruding portions 51*a* and 51*c* are open to the space 51V via through holes made through the upper wall of the tank 51. The protruding portion 51*b* is connected to a cylindrical member 51*b*2 which protrudes downward in the tank 51. The internal spaces of the protruding portion 51*b* and the cylindrical member 51*b*2 are connected with each other via a through hole made through the upper wall of the tank 51, so as to form an atmosphere connection path 51*bf* which connects the space 51V with the atmosphere.

Around the protruding portion 51*a* of each tube 52*a* is provided a valve 52*av* which opens or closes the outflow path 52*af*. Around the protruding portion 51*c* of each tube 52*c* is provided a valve 52*cv* which opens or closes the inflow path 52*cf*. Around the upper end of the protruding portion 51*b* is provided a valve 51*bv* which opens or closes the atmosphere connection path 51*bf*. These valves 51*bv*, 52*av*, and 52*cv* are opened or closed under the control of the controller 1*p*.

Figure 9:
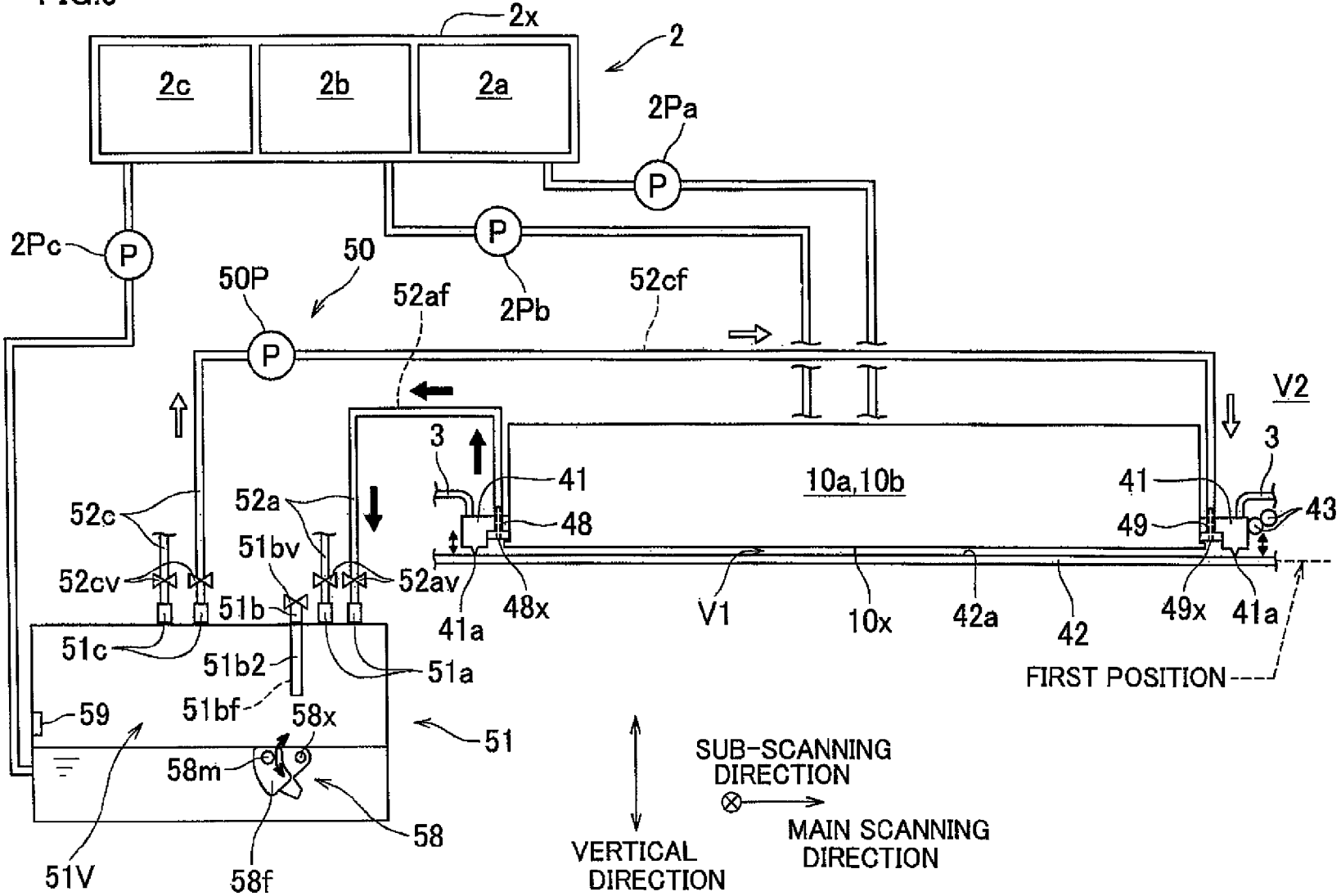
FIG. 9 illustrates a moisturization operation.

To conduct the moisturization operation, the controller 1*p* sets the capping mechanism 40 in the capped state and drives the moisturizing pump SOP while keeping the valves 51*bv*, 52*av*, and 52*cv* to be open. As a result, the air in the ejection space V1 is collected through an opening 48*x* on the lower surface of the joint 48, passes through the outflow path 52*af* in the tube 52*a*, and eventually flows into the space 51V. The air having flown into the space 51V is moisturized by (the natural evaporation of) the moisturizing liquid stored in the space 51V, and then passes through the inflow path 52*cf* in the tube 52*c* and reaches the ejection space V1 via an opening 49*x* on the lower surface of the joint 49. In FIG. 9, black arrows indicate the flow of air before the moisturization, whereas outline arrows indicate the flow of air after the moisturization.

The tank 51 is provided with a water level sensor 58 which detects the water level of moisturizing liquid. The water level sensor 58 includes a float 58*f* and a magnetic sensor (not illustrated) which detects the existence of a magnet 58*m* fixed to the float 58*f*. The float 58*f* is swingable about a shaft 58*x* fixed to a side wall of the tank 51. As air is enclosed therein, the float 58*f* swings to follow the movement of the surface of the moisturizing liquid. The magnetic sensor detects whether the position of the magnet 58*m* is at the position indicating the maximum water level of the tank 51. Before conducting the moisturization operation, based on a detection signal from the water level sensor 58, the controller 1*p* drives a pump 2Pc (see FIG. 10) to supply the moisturizing liquid from the moisturizing liquid container 2*c* to the space 51V so that the water level of the moisturizing liquid stored in the space 51V is at the maximum (as shown in FIG. 9), when the moisturizing liquid stored in the space 51V is not at the maximum water level.

On an inner wall surface of the tank 51 is disposed a temperature-humidity sensor 59. This temperature-humidity sensor 59 outputs a signal relative to the temperature and humidity in the space 51V.

Figure 11:
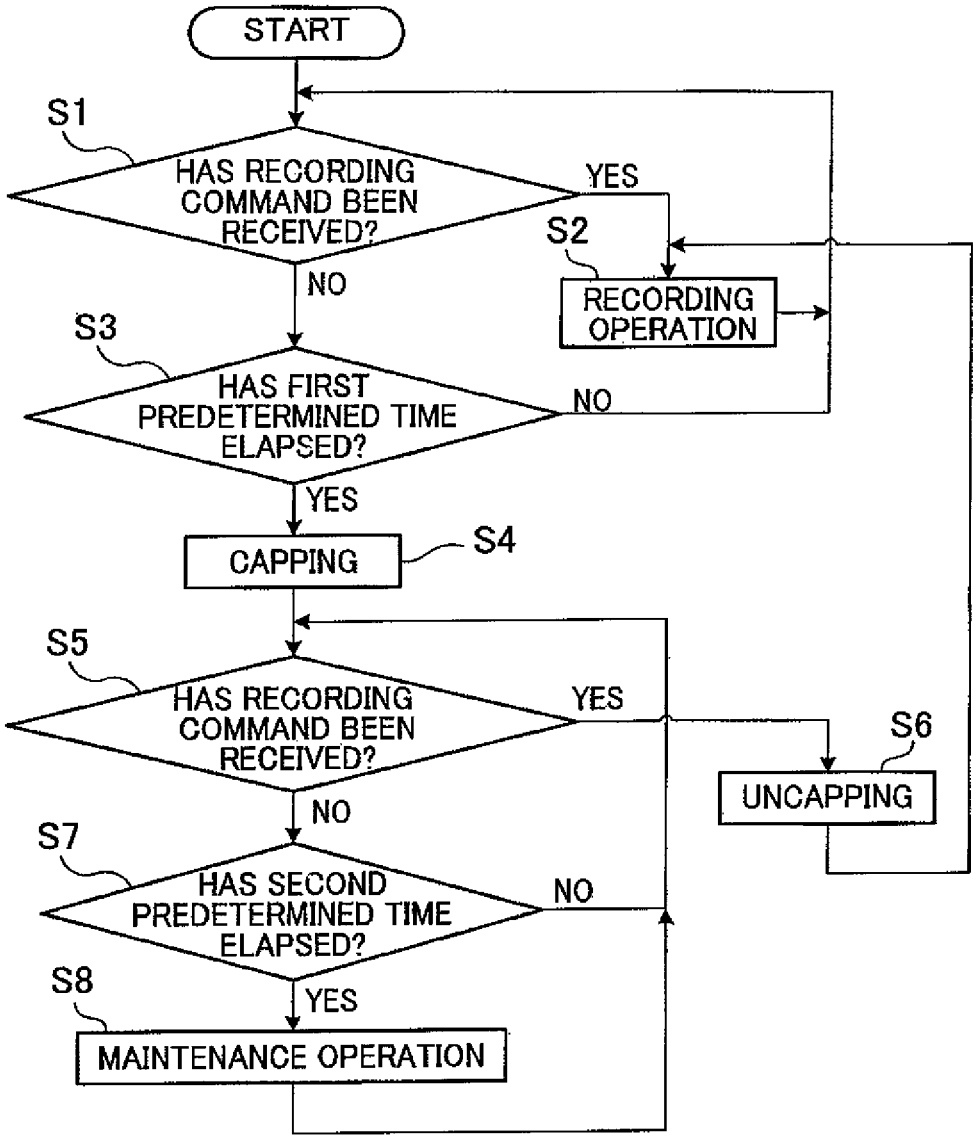
FIG. 11 is a flowchart showing the control executed by a controller.

Now, referring to FIG. 11 and FIG. 12, the control executed by the controller 1*p* will be described. The measurement of time is conducted by using an internal timer or the like.

To begin with, the controller 1*p* determines whether a recording command has been received (S1). When having received the recording command (S1: YES), the controller 1*p* controls the members so that a recording operation is executed (S2). When hot having received the recording command (S1: NO), the controller 1*p* determines whether a first predetermined time has elapsed after the previous recording command is received (S3). When the first predetermined time has not elapsed (S3: NO), the controller 1*p* goes back to S1.

When the first predetermined time has elapsed (S3: YES), the controller 1*p* switches the state of the capping mechanism 40 to the capped state (S4). Thereafter, in the same manner as S1, the controller 1*p* determines whether the recording command has been received (S5). When having received the recording command (S5: YES), the controller 1*p* switches the state of the capping mechanism 40 to the uncapped state and goes back to S2.

When not having received the recording command (S5: NO) the controller 1*p* determines whether a second predetermined time (>first predetermined time) has elapsed after the previous recording command is received (S7). The second predetermined time may be set as 24 hours, for example, and may be changed in accordance with the content of the immediately preceding maintenance operation. When the second predetermined time has not elapsed (S7: NO), the controller 1*p* goes back to S5. When the second predetermined time has elapsed (S7: YES), the controller 1*p* executes a maintenance operation (S8) and then goes back to S5.

After the capping in S4, time passes without receiving the recording command, and the capping mechanism 40 is maintained to be in the capped state until the maintenance operation is executed in S8. The maintenance operation is an operation to restore or maintain the state of the liquid in the ejection openings 14*a*, and is regularly conducted while the capped state is maintained. The maintenance operation is either a moisturization operation or a liquid discharge operation (which is flushing or purging). Which one of the flushing and the purging is conducted in the liquid discharge operation may be determined in accordance with the amount of liquid to be discharged.

The ROM of the controller 1*p* stores an operation pattern table (see FIG. 12). The table stores a plurality of operation patterns that are different from one another and correspond to different times of the maintenance operation. The table shown in FIG. 12 stores three operation patterns (an operation pattern A, an operation pattern B, and an operation pattern C) that are different from one another and each relates to four times of the maintenance operation. The controller 1*p* selects one of the operation patterns stored in the ROM and executes the maintenance operation based on the selected operation pattern. When the operation pattern A is selected, in the following maintenance operation, the moisturization operation is conducted in the maintenance operation of the first time to the third time, and the liquid discharge operation is conducted in the maintenance operation of the fourth time. When the operation pattern B is selected, in the following maintenance operation, the moisturization operation is conducted in the maintenance operation of the first time, the liquid discharge operation is conducted in the maintenance operation of the second time, the moisturization operation is conducted in the maintenance operation of the third time, and the liquid discharge operation is conducted in the maintenance operation of the fourth time. When the operation pattern C is selected, in the following maintenance operation, the moisturization operation is conducted in the maintenance operation of the first time and the liquid discharge operation is conducted in the maintenance operation of the second to fourth times. In all of the operation patterns A to G, a pattern in which the liquid discharge operation is conducted after the moisturization operation is included.

When the capping mechanism 40 becomes in the uncapped state as the recording command is received while, the maintenance operation of the fourth time is being conducted based on one operation pattern, an operation pattern is selected again for the next maintenance operation.

When the maintenance operation is the moisturization operation, the controller 1*p* conducts the moisturization operation by driving the moisturizing pump 50P for a predetermined time and then switches the driving mode of the moisturizing pump 50P from a normal mode to a power saving mode.

When the maintenance operation is the liquid discharge operation, the controller 1*p* controls the members so that the liquid discharge operation is conducted (i.e., controls the actuator unit 17 in the case of the flushing or controls the pumps 2Pa and 2Pb in the case of the purging). The controller 1*p* then controls a wiper drive motor 36M or the like to conduct the wiping of the opposing surface 42*a* after the flushing or conduct the wiping of the ejection surface 10*x* and the opposing surface 42*a* after the purging. After the wiping, the controller 1*p* executes the moisturization operation by driving the moisturizing pump 50P for a predetermined time, and switches the driving mode of the moisturizing pump 50P from the normal mode to the power saving mode after the end of the moisturization operation.

In the power saving mode, the power consumption is restrained as compared to the normal mode. When the driving mode of the moisturizing pump 50P is switched from the normal mode to the power saving mode, the controller 1*p* turns off the power of the control substrate of the moisturizing pump 50P so as to eliminate a standby current. After beings switched from the normal mode to the power saving mode, the driving mode of the moisturizing pump 50P is maintained to be the power saving mode until the next moisturization operation, and is switched from the power saving mode to the normal mode before the moisturizing pump 50P is driven in the next moisturization operation. When the driving mode of the moisturizing pump SOP is switched from the power saving mode to the normal mode, the controller 1*p* turns on the power of the control substrate of the moisturizing pump 50P.

Now, how an operation pattern is selected will be described.

The controller 1*p* selects the operation pattern A for the maintenance operation of the first time after a new cartridge 2 is attached to the upper housing 1*a*. Thereafter, when the next maintenance operation is executed after the maintenance operation corresponding to the operation pattern A is conducted four times or when the next maintenance operation is executed after the recording command is received while the maintenance operation of the first, second, third, or fourth time corresponding to the operation pattern A is being conducted, the controller 1*p* newly selects an operation pattern based on the remaining amount o ft moisturizing liquid in the moisturizing liquid container 2*c*. When the remaining amount of the moisturizing liquid in the moisturizing liquid container 2*c* is smaller than a predetermined amount, the controller 1*p* selects, from the operation patterns A to C, an operation pattern in which the frequency of conducting the moisturization operation is lower than the frequency in the currently selected operation pattern and the frequency of conducting the liquid discharge operation is higher than the frequency in the currently selected operation pattern.

Based on the frequency of driving the pump 2Pc, the controller 1*p* works out the remaining amount of the moisturizing liquid in the moisturizing liquid container 2*c*. More specifically, because the amount of the moisturizing liquid supplied from the moisturizing liquid container 2*c* to the tank 51 by one driving of the pump 2Pc is known and the amount of the moisturizing liquid stored in the moisturizing liquid container 2*c* of a new cartridge 2 is known, it is possible to work out the remaining amount of the moisturizing liquid in the moisturizing liquid container 2*c* based on how many times the pump 2Pc has been driven after a new cartridge 2 is attached to the upper housing 1*a*.

As described above, in the printer 1 of the present embodiment, the maintenance operation conducted more than once while the capped state is maintained includes a pattern in which the liquid discharge operation is conducted after the moisturization operation (see the operation patterns A to C in FIG. 12). As such, because not only the moisturization operation but also the liquid discharge operation is conducted in the maintenance operation which is executed more than once while the capped state is maintained, the concentration of the liquid in the ejection openings 14*a* is maintained to fall within a predetermined range.

When the maintenance operation is the liquid discharge operation, the controller 1*p* conducts the moisturization operation after the liquid discharge operation. This arrangement elongates the time interval of performing the maintenance operation.

When the maintenance operation is the liquid discharge operation, the controller 1*p* controls the wiper 36*b* so that the liquid is removed from the capping mechanism 40 after the liquid discharge operation. If the capping mechanism 40 takes the capped state while the liquid is adhered to the inside of the capping mechanism 40, the moisture in the ejection space V1 is lowered due to the presence of the liquid, with the result that the concentration of the liquid in the ejection opening 14*a* may become excessively high. The arrangement above restrains the occurrence of such a problem.

When the maintenance operation is the liquid discharge operation, the controller 1*p* switches the driving mode of the moisturizing pump 50P from the normal mode to the power saving mode after the liquid discharge operation. This arrangement makes it possible to achieve the power saving.

The controller 1*p* selects one of the operation patterns A to C stored in the ROM and executes the maintenance operation based on the selected operation pattern. When the remaining amount of the moisturizing liquid in the moisturizing liquid container 2*c* is smaller than a predetermined amount, the controller 1*p* selects, from the operation patterns A to C stored in the ROM, an operation pattern in which the frequency of conducting the moisturization operation is smaller than the frequency in the currently selected operation pattern and the frequency of conducting the liquid discharge operation is larger than the frequency in the currently selected operation pattern, and executes the subsequent maintenance operation based on the selected operation pattern. According to this arrangement, because the frequency of the moisturization operation is reduced when the remaining amount of the moisturizing liquid in the moisturizing liquid container 2*c* becomes small, the reduction of the moisturizing liquid in the moisturizing liquid container 2*c* is restrained and the life of the cartridge 2 is elongated.

The cartridge 2 includes not only the moisturizing liquid container 2*c* but also a preprocessing liquid container 2*a* and an ink container 2*b*. The rate of consumption of the liquid ejected from the heads 10*a* and 10*b* is typically higher than the rate of consumption of the moisturizing liquid, and hence the containers 2*a* and 2*b* become empty more often than the moisturizing liquid container 2*c*. In this regard, as the frequency of the moisturization operation is decreased and the frequency of the liquid discharge operation is increased when the remaining amount of the moisturizing liquid in the moisturizing liquid container 2*c* becomes small as described above, the liquid in the containers 2*a* and 2*b* is actively consumed while the reduction of the moisturizing liquid in the moisturizing liquid container 2*c* is restrained. This causes the containers 2*a* to 2*c* to become empty more or less simultaneously, and hence the containers 2*a* to 2*c* are all substantially empty when the cartridge 2 is replaced with a new cartridge 2. On this account, it is possible to avoid an uneconomical situation that a lot of liquid or moisturizing liquid remains in any of the containers 2*a* to 2*c* when the cartridge 2 is replaced.

Now, inkjet printers according to Second and Third Embodiments of the present invention will be described. The printers of Second and Third Embodiments are identical with the printer 1 of the First Embodiment except how the controller 1*p* selects the content of the maintenance operation. The arrangements identical with those in First Embodiment will not be described.

According to Second Embodiment, the ROM of the controller 1*p* does not store an operation pattern table, and the controller 1*p* selects the moisturization operation as the maintenance operation until the amount of the moisturizing liquid in the moisturizing liquid container 2*c* becomes zero. When the amount of the moisturizing liquid in the moisturizing liquid container 2*c* becomes zero, the controller 1*p* executes the moisturization operation in the subsequent maintenance operation, for the number of times determined based on a signal from the temperature-humidity sensor 59. The number of times to conduct the moisturization operation may be reduced in proportion to the increase in the temperature of the space 51V and the decrease in the moisture in the space 51V. In the maintenance operation after the moisturization operation is conducted for the determined number of times, the controller 1*p* conducts the liquid discharge operation without conducting the moisturization operation.

According to the printer of Second Embodiment, even when the remaining amount of the moisturizing liquid in the moisturizing liquid container 2*c* becomes zero, the moisturization operation is executable by using the moisturizing, liquid in the tank 51. In this regard, because the rate of consumption of the moisturizing liquid in the tank 51 depends on the temperature and humidity in the tank 51, the number of times to conduct the moisturization operation using the moisturizing liquid in the tank 51 is determined based on the temperature and humidity in the tank 51. After the moisturization operation is conducted for the determined number of times, the moisturization operation is not conducted and only the liquid discharge operation is conducted. As such, in Second Embodiment the maintenance operation is suitably conducted in accordance with the remaining amount of the moisturizing liquid.

According to Third Embodiment, the ROM of the controller 1*p* does not store an operation pattern table, and the controller 1*p* selects the moisturization operation as the maintenance operation until the amount of the moisturizing liquid remaining in the moisturizing liquid container 2*c* becomes zero. When the remaining amount of the moisturizing liquid in the moisturizing liquid container 2*c* becomes zero, the controller 1*p* conducts the liquid discharge operation without conducting the moisturization operation, in the subsequent maintenance operation.

In the printer of Third Embodiment, a suitable maintenance operation in accordance with the remaining amount of the moisturizing liquid is realized with a relatively simple structure.

In Second and Third Embodiments, the controller 1*p* may determine that the amount of the moisturizing liquid remaining in the moisturizing liquid container 2*c* as become zero, when the water level of the moisturizing liquid in the tank 51 does not reach the maximum water level even if the pump 2Pc is driven for a predetermined time.

The liquid ejection apparatus is not limited to the printer, but may be a facsimile machine, a photocopier, or the like. The housing of the liquid ejection apparatus is not necessarily composed of two, i.e., upper and lower housings. The housing may be a single housing. The number of heads in the liquid ejection apparatus is any arbitrary number not smaller than one. When more than one head is included in the liquid ejection apparatus, a tank may be provided for each head. The head may eject any type of liquid different from black ink and preprocessing liquid. The head is not necessarily a line-type head but may be a serial-type head. The recording medium is not limited to a sheet P but may be any type of recordable medium. In the embodiments above, the ejection space may be separated from the space surrounding the ejection space as the annular member 41 contacts not the opposing member 42 but a supporting member (a platen, a conveyance belt or the like) supporting a recording medium. The capping mechanism is not necessarily composed of a plurality of members (such as the annular member 41 and the opposing member 42 in the embodiments above). For example, the capping mechanism may be constituted by a single concave member which has, on its upper surface, a concave portion which is substantially identical in size with the ejection surface. The tank may be provided with a heater for heating the moisturizing liquid. The water level sensor 58 may not be provided. In such a case, an opening for discharging liquid may be disposed slightly vertically above the maximum water level to discharge the moisturizing liquid through the opening when the water level of the moisturizing liquid exceeds the maximum water level. The moisturization mechanism may be any mechanism different from the tank storing moisturizing liquid, on condition that the air passing through the inflow path is moisturized. For example, a mist generator is used as the moisturization mechanism and mist is supplied to the inflow path. The air passing through the inflow path may be moisturized by ultrasonic moisturization or heat moisturization. The outflow path is not limited to the relatively long path formed in the tube as in the embodiments above. The outflow path may be a relatively short path constituted by a through hole made through the joint 48 of the embodiment above or the like, for example. The atmosphere connection path may not be provided. The valves for opening and closing the inflow path, the outflow path, the atmosphere connection path or the like may not be provided. The ventilator may be disposed on the inflow path or the outflow path, or on both of these paths. Instead of the sensor configured to output a signal relative to both the temperature and humidity in the tank, a sensor configured to output a signal relative to one of the temperature and humidity in the tank may be provided. The sensor may not be provided. In the liquid discharge operation, at least one of the flushing and the purging is conducted, or both of the flushing and the purging are conducted. The purging is not limited to the pressure purging as in the embodiments above, and may be suction purging. In such a case, for example, the pressure in the ejection space is changed to negative pressure by driving a suction pump connected to the capping mechanism, so that the liquid in the ejection opening is sucked. The moisturization operation may be conducted after the capping mechanism becomes in the capped state in S4, in addition to S8. In this case, because the moisturization operation is conducted before the maintenance operation, the increase in the viscosity of the liquid in the ejection openings 14*a* is restrained, and hence the interval (second predetermined time) of conducting the maintenance operation can be elongated. A memory storing a plurality of operation patterns may not be provided. For example, the controller may conduct relatively simple control such that the moisturization operation is selected as the maintenance operation when the remaining amount of the moisturizing liquid is not smaller than a predetermined amount, and the liquid discharge operation is selected as the maintenance operation when the remaining amount of the moisturizing liquid is smaller than the predetermined amount. When the remaining amount of the moisturizing liquid is zero, in the subsequent maintenance operation, the moisturization operation may be conducted for a predetermined number of times not based on the temperature and humidity in the tank, and the liquid discharge operation may be conducted after the moisturization operation is conducted for the predetermined number of times. A sensor for detecting a remaining amount, which is disposed in the moisturizing liquid container, may be used instead of the pump 2Pc. When the maintenance operation is the moisturization operation, the driving mode of the ventilator may not be switched to the power saving mode after the moisturization operation. When the maintenance operation is the liquid discharge operation, after the liquid discharge operation, the driving mode of the ventilator may be switched to the power saving mode without conducting the moisturization operation. In this case, while the effect of the moisturization operation is not attained, the power saving is achieved in a relatively short time by promptly switching to the power saving mode, because the time required to conduct the liquid discharge operation is typically shorter than the time required to conduct the moisturization operation. When the maintenance operation is the liquid discharge operation, the wiping, the moisturization operation, the switching to the power saving mode or the like may not be conducted after the liquid discharge operation. When switching to the power saving mode, the embodiments are arranged so that the standby current is eliminated by turning off the power of the control substrate of the ventilator. The disclosure, however, is not limited to this arrangement. For example, a stepping motor is used and a holding current is eliminated by cutting off the voltage supplied to the ventilator. A cartridge including a moisturizing liquid container and a cartridge including a liquid container may be independently provided.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a head comprising an ejection surface in which a plurality of ejection openings for ejecting liquid are formed;

a capping mechanism configured to selectively take a capped state in which an ejection space opposing the ejection surface is covered or an uncapped state in which the ejection space is not covered;

a discharger configured to discharge liquid in the head through the ejection openings;

an inflow path configured to be connected to the ejection space when the capping mechanism is in the capped state and to allow air flow towards the ejection space passing through the inflow path;

an outflow path configured to be connected to the ejection space when the capping mechanism is in the capped state and to allow air flow from the ejection space passing through the outflow path;

a moisturization mechanism configured to moisturize the air passing through the inflow path;

a ventilator configured to move the air in the inflow path to the ejection space;

a wiper configured to remove the liquid on an entire inner surface of the capping mechanism by moving relative to the capping mechanism while contacting the inner surface, the inner surface opposing and distant from the ejection surface when a liquid discharge operation with which the liquid is discharged through the ejection openings by the discharger is conducted and receiving the liquid discharged on account of the liquid discharge operation; and a controller configured to:

maintain the capping mechanism to be in the capped state while a recording command to record an image on a recording medium by ejecting the liquid through the ejection openings is not received;

regularly select one of (i) a moisturization operation with which air moisturized by the moisturization mechanism is moved to the ejection space by the ventilator while the capping mechanism is maintained to be in the capped state and (ii) the liquid discharge operation, and conduct the selected operation while the recording command is not received;

conduct the liquid discharge operation after the moisturization operation while the recording command is not received; and control the wiper to remove the liquid on the entire inner surface of the capping mechanism after the liquid discharge operation.

2. The liquid ejection apparatus according to claim 1, wherein:

the controller is configured to conduct the moisturization operation after the liquid discharge operation.

3. The liquid ejection apparatus according to claim 1, wherein:

the controller is configure to switch a driving mode of the ventilator from a normal mode to a power saving mode in which power consumption is restrained as compared to the normal mode, after the liquid discharge operation.

4. A liquid ejection apparatus comprising:

a head comprising an ejection surface in which a plurality of ejection openings for ejecting liquid are formed;

a capping mechanism configured to selectively take a capped state in which an ejection space opposing the ejection surface is covered or an uncapped state in which the ejection space is not covered;

a discharger configured to discharge liquid in the head through the ejection openings;

an inflow path configured to be connected to the ejection space when the capping mechanism is in the capped state and to allow air flow towards the ejection space passing through the inflow path;

an outflow path configured to be connected to the ejection space when the capping mechanism is in the capped state and to allow air flow from the ejection space passing through the outflow path;

a moisturization mechanism configured to moisturize the air passing through the inflow path;

a ventilator configured to move the air in the inflow path to the ejection space;

a wiper configured to remove the liquid on an inner surface of the capping mechanism by moving relative to the capping mechanism while contacting the inner surface, the inner surface opposing and distant from the ejection surface when a liquid discharge operation with which the liquid is discharged through the ejection openings by the discharger is conducted and receiving the liquid discharged on account of the liquid discharge operation;

a controller configured to:

maintain the capping mechanism to be in the capped state while a recording command to record an image on a recording medium by ejecting the liquid through the ejection openings is not received;

regularly select one of (i) a moisturization operation with which air moisturized by the moisturization mechanism is moved to the ejection space by the ventilator while the capping mechanism is maintained to be in the capped state and (ii) the liquid discharge operation, and conduct the selected operation while the recording command is not received;

conduct the liquid discharge operation after the moisturization operation while the recording command is not received; and control the wiper to remove the liquid on the inner surface of the capping mechanism after the liquid discharge operation;

a tank configured to store moisturizing liquid and is provided in the moisturization mechanism;

a cartridge comprising a moisturizing liquid container comprising the moisturizing liquid and configured to be connected to the tank; and a memory which stores a plurality of operation patterns, the operation patterns being different from one another and relating to the operations conducted a plurality of times while the recording command is not received, wherein:

the controller is configured to determine a remaining amount of the moisturizing liquid in the moisturizing liquid container;

the controller is configured to select one of the operation patterns stored in the memory and conduct the liquid discharging operation or the moisturization operation based on the selected one of the operation patterns; and when the remaining amount of the moisturizing liquid determined by the controller is smaller than a predetermined amount, the controller is configured to select one of the operation patterns stored in the memory, with which the frequency of the moisturization operation is lower than the frequency of the moisturization operation in the currently-selected one of the operation patterns and the frequency of the liquid discharge operation is higher than the frequency of the liquid discharge operation in the currently-selected one of the operation patterns, and is configured to conduct the liquid discharging operation or the moisturization operation based on the newly selected one of the operation patterns.

5. The liquid ejection apparatus according to claim 4, wherein:

the cartridge further comprises a liquid container comprising the liquid and configured to be connected to the head.

6. A liquid ejection apparatus according comprising:

a head comprising an ejection surface in which a plurality of ejection openings for ejecting liquid are formed;

a capping mechanism configured to selectively take a capped state in which an ejection space opposing the ejection surface is covered or an uncapped state in which the ejection space is not covered;

a discharger configured to discharge liquid in the head through the ejection openings;

an inflow path configured to be connected to the ejection space when the capping mechanism is in the capped state and to allow air flow towards the ejection space passing through the inflow path;

an outflow path configured to be connected to the ejection space when the capping mechanism is in the capped state and to allow air flow from the ejection space passing through the outflow path;

a moisturization mechanism configured to moisturize the air passing through the inflow path;

a ventilator configured to move the air in the inflow path to the ejection space;

a wiper configured to remove the liquid on an inner surface of the capping mechanism by moving relative to the capping mechanism while contacting the inner surface, the inner surface opposing and distant from the ejection surface when a liquid discharge operation with which the liquid is discharged through the ejection openings by the discharger is conducted and receiving the liquid discharged on account of the liquid discharge operation;

a controller configured to:

maintain the capping mechanism to be in the capped state while a recording command to record an image on a recording medium by ejecting the liquid through the ejection openings is not received;

regularly select one of (i) a moisturization operation with which air moisturized by the moisturization mechanism is moved to the ejection space by the ventilator while the capping mechanism is maintained to be in the capped state and (ii) the liquid discharge operation, and conduct the selected operation while the recording command is not received;

conduct the liquid discharge operation after the moisturization operation while the recording command is not received; and control the wiper to remove the liquid on the inner surface of the capping mechanism after the liquid discharge operation;

a tank configured to store moisturizing liquid and is provided in the moisturization mechanism;

a cartridge comprising a moisturizing liquid container comprising the moisturizing liquid and configured to be connected to the tank; and a sensor configured to output a signal relative to at least one of temperature and humidity in the tank, wherein:

the controller is configure to determine a remaining amount of the moisturizing liquid in the moisturizing liquid container; and when the remaining amount of the moisturizing liquid determined by the controller is zero, the controller is configured to conduct the moisturization operation for the number of times determined based on the signal, and is configured to conduct the liquid discharge operation without conducting the moisturization operation after the moisturization operation is conducted for the determined number of times.

7. The liquid ejection apparatus according to claim 1, further comprising:

a tank configured to store moisturizing liquid and is provided in the moisturization mechanism; and a cartridge comprising a moisturizing liquid container comprising the moisturizing liquid and being connected to the tank, wherein:

the controller is configure to determine a remaining amount of the moisturizing liquid in the moisturizing liquid container; and when the remaining amount of the moisturizing liquid determined by the controller is zero, the controller is configured to conduct the liquid discharge operation without conducting the moisturization operation.

* * * * *